US007236730B2

(12) United States Patent
Dickerson et al.

(10) Patent No.: US 7,236,730 B2
(45) Date of Patent: Jun. 26, 2007

(54) DAMPENING MECHANISM FOR AN IMAGE FORMING APPARATUS

(75) Inventors: James Eric Dickerson, Lexington, KY (US); Robert Edward Hackett, Lexington, KY (US); Donald Thomas Kral, Lexington, KY (US); Donald Wayne Stafford, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 198 days.

(21) Appl. No.: 10/990,893

(22) Filed: Nov. 17, 2004

(65) Prior Publication Data

US 2006/0104676 A1 May 18, 2006

(51) Int. Cl.
*G03G 15/08* (2006.01)

(52) U.S. Cl. ..... 399/284; 118/261

(58) Field of Classification Search ..... 399/284, 399/274, 286, 350, 351; 118/261; 430/120
See application file for complete search history.

(56) References Cited

U.S. PATENT DOCUMENTS

| | | | | | |
|---|---|---|---|---|---|
| 4,334,766 | A | * | 6/1982 | Sugiyama et al. | 399/351 |
| 4,498,760 | A | * | 2/1985 | Sugiyama | 399/351 |
| 5,070,783 | A | | 12/1991 | Ireton | 101/349.1 |
| 5,085,171 | A | | 2/1992 | Aulick et al. | 399/284 |
| 5,337,032 | A | | 8/1994 | Baker et al. | 399/111 |
| 5,623,718 | A | | 4/1997 | Bracken et al. | 399/284 |
| 5,702,812 | A | | 12/1997 | Bracken et al. | 428/323 |
| 5,708,943 | A | | 1/1998 | Applegate et al. | 399/284 |
| 5,797,076 | A | | 8/1998 | Bracken et al. | 399/284 |
| 5,853,868 | A | | 12/1998 | Bracken et al. | 399/284 |
| 5,913,626 | A | | 6/1999 | Ishida et al. | 400/625 |
| 6,021,297 | A | | 2/2000 | Campbell et al. | 399/284 |
| 6,027,266 | A | | 2/2000 | Turner | 400/208 |
| 6,049,689 | A | * | 4/2000 | Ishii et al. | 399/284 |
| 6,078,771 | A | | 6/2000 | Buchanan et al. | 399/284 |
| 6,128,461 | A | * | 10/2000 | Yoshikawa | 399/350 |
| 6,183,079 | B1 | | 2/2001 | Meade et al. | 347/101 |
| 6,232,994 | B1 | | 5/2001 | Wiklof | 347/177 |
| 6,510,291 | B2 | | 1/2003 | Campbell et al. | 399/27 |
| 6,697,594 | B1 | | 2/2004 | Murphy et al. | 399/284 |
| 6,706,118 | B2 | | 3/2004 | Heink et al. | 118/697 |
| 6,771,922 | B2 | | 8/2004 | Blanck et al. | 399/260 |
| 2002/0127036 | A1 | * | 9/2002 | Sato et al. | 399/350 |
| 2002/0154916 | A1 | | 10/2002 | Stirling et al. | 399/27 |

FOREIGN PATENT DOCUMENTS

| | | | | |
|---|---|---|---|---|
| JP | 58-149085 | A | * | 9/1983 |
| JP | 2001-051501 | A | * | 2/2001 |

* cited by examiner

*Primary Examiner*—Sophia S. Chen
(74) *Attorney, Agent, or Firm*—Coats & Bennett, PLLC

(57) ABSTRACT

There is provided a system and mechanism for substantially reducing or substantially eliminating vibration or noise of a doctor blade of an image forming apparatus during operation. The system and mechanism provided includes at least one contact in communication with a doctor blade surface, e.g., a front surface, to substantially reduce or substantially eliminate vibration and/or noise associated with a doctor blade during image forming.

25 Claims, 1 Drawing Sheet

DAMPENING MECHANISM FOR AN IMAGE FORMING APPARATUS

TECHNICAL FIELD OF THE INVENTION

The invention is directed to an image forming apparatus and, more particularly, e.g., to a toner cartridge of an image forming apparatus having a noise and/or vibration dampening mechanism.

BACKGROUND OF THE INVENTION

Image forming devices including copiers, laser printers, facsimile machines, and the like, include a photo conductive drum (hereinafter "photoconductor") having a rigid cylindrical surface that is coated along a defined length of its outer surface. The surface of the photoconductor is typically charged to a uniform electrical potential and then selectively exposed to light in a pattern corresponding to an original image. The areas of the photoconductive surface exposed to light are discharged, thus forming a latent electrostatic image on the photoconductive surface. A developer material, such as toner, having an electrical charge such that the toner is attracted to the photoconductive surface is used for forming the image. The toner is normally stored in a reservoir adjacent to the photoconductor and is transferred to the photoconductor by the developer roll. The thickness of the toner layer on the developer roll may be controlled by a nip, which is typically formed between a doctor blade and the developer roll. A recording sheet, such as a blank sheet of paper, may then be brought into contact with the discharged photoconductive surface and the toner therein is transferred to the recording sheet in the form of the latent electrostatic image. The recording sheet may then be heated thereby permanently fusing the toner to the sheet. In preparation for the next image forming cycle, the photoconductive surface may be discharged and residual toner removed.

Maintaining consistent contact and pressure with the developer roll may be problematic due to the fact that the developer roll profile may be non-uniform and thus, require the doctor blade to possibly move inward and outward to track the surface of the developer roll. Additionally, contact may be maintained across the entire length of the doctor blade to ensure even print quality across the entire width of the image. One problem in some prior systems, may be the undesirable vibration caused by the contact of the doctor blade with the developer roll, especially towards the end of a cartridge's life which may cause jitter. This problem has been addressed in some products by applying a foam seal behind the doctor blade. However, the geometries/configurations of some products, which also suffer from that problem and noise caused by the vibration, do not allow for the placement of seals or any dampening materials/extensions behind the blade.

SUMMARY OF EMBODIMENTS OF THE INVENTION

The present invention according to one embodiment, may be directed to a toner cartridge for an image forming apparatus comprising the following: a doctor blade having top, back, front and bottom surfaces, the doctor blade having a vibration frequency during image forming, and first and second extensions positioned in communication with two locations on a doctor blade surface, e.g., a doctor blade front surface.

The present invention, according to another embodiment, may be comprised of a system and/or mechanism having the following: at least two extensions and/or contacts; the extensions and/or contacts in dampening communication with the front surface of a doctor blade to, e.g., substantially dampen, substantially reduce, and/or substantially eliminate audible vibration and/or noise associated with the blade of the image forming apparatus during image forming.

In addition, the present invention according to a further embodiment, provides a mechanism and/or system for substantially dampening, substantially reducing, and/or substantially eliminating vibration and/or noise associated with a doctor blade of an image forming apparatus comprising the following: at least one extension and/or contact in communication with the doctor blade, said extension and/or contact positioned relative to a doctor blade surface to, e.g., substantially dampen, reduce, and/or eliminate vibration and/or noise associated with the doctor blade.

According to another embodiment, the present invention is directed to a method for substantially reducing noise created by the movement of a doctor blade of an image forming apparatus during image forming. The method may comprise constraining a surface of the doctor blade during image forming at a point or points, e.g., two points along the front surface located, e.g., on either side of a center point of the blade such that any blade vibrations are, e.g., substantially shifted to inaudible frequencies.

While the present invention, according to same embodiments, is discussed/described herein in relation to a specific image forming apparatus and a given toner cartridge geometry/configuration, it will be apparent to persons skilled in the art, that the present invention, according to certain embodiments, is equally applicable to other image forming apparatuses and toner cartridges of various geometries and/or configurations and various other doctor blade/developer roll geometries and/or configurations. By way of example only, toner cartridges having geometries which allow for the addition of a seal behind the doctor blade, may alternatively or in addition utilize the present invention also.

BRIEF DESCRIPTION OF THE DRAWINGS

A more complete understanding of embodiments of the present invention may be acquired by referring to the following description taken in conjunction with the accompanying drawings wherein.

DETAILED DESCRIPTION OF EMBODIMENTS OF THE INVENTION

Figure 1:
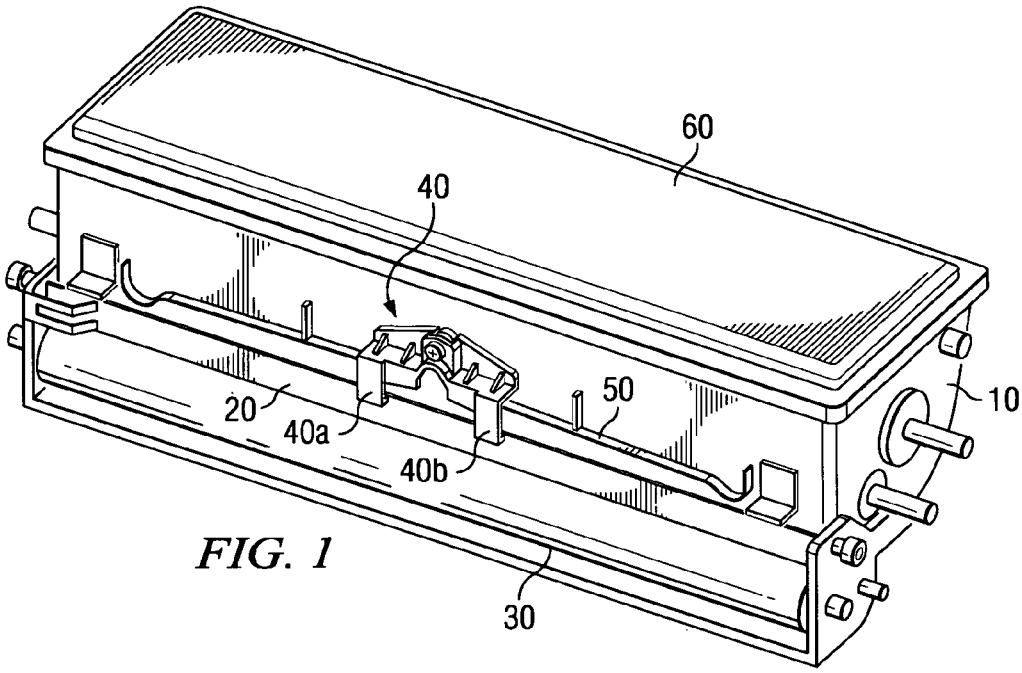
FIG. 1 illustrates a cartridge with doctor blade extensions according to an embodiment of the present invention.
Figure 2:
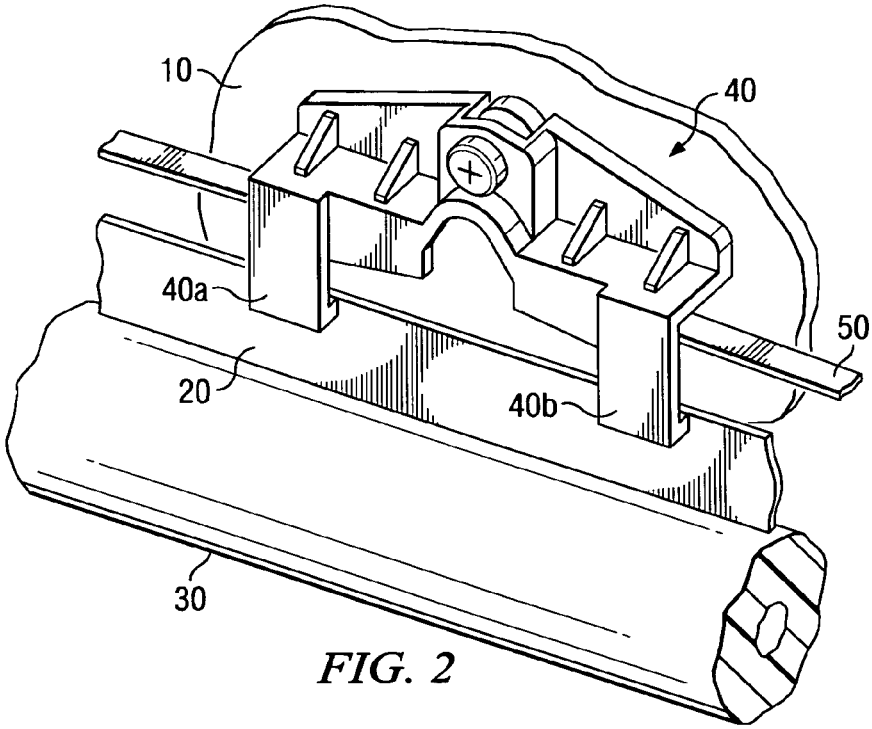
FIG. 2 illustrates an enlarged image of a doctor blade with extensions according to an embodiment of the present invention.

FIGS. 1 and 2 illustrate an example cartridge configuration, for illustration purposes only, according to an embodiment of the present invention. Specifically, FIG. 1 illustrates one embodiment of a developer housing 10 with doctor blade 20 positioned adjacent to or against developer roll 30. A biasing member 50 attached to the developer housing 10 may be positioned above the doctor blade 20 to possibly maintain a continuous force to bias the doctor blade 20 toward and against the developer roll 30. The amount of force applied by biasing member 50 may also control the amount of toner transferred to developer roll 30.

The drawings herein illustrate doctor blade 20 substantially perpendicular to the developer roll 30, however, other orientations may also provide for transfer of proper toner amounts. The biasing member 50 may contact the top surface of the doctor blade 20 along the length of doctor blade 20 to ensure an even and distributed force may be applied across the entire width of the developer roll 30. According to an embodiment of the present invention, biasing member 50 may provide, e.g., about 1400 grams of force to the developer roll 30. However, depending upon the doctor blade/developer roll geometries and/or configurations, the force applied by biasing member 50 may vary to achieve varying, proper and/or appropriate toner amounts as known in the art.

As illustrated in FIGS. 1 and 2, the present invention, according to an embodiment, includes a biasing member holder, e.g., a leaf spring holder 40, having extensions 40*a* and 40*b* for communication with a doctor blade 20 surface. Either the extensions themselves can be in communication with the doctor blade and/or additional contacts attached to the end of the extensions may be in communication with the doctor blade. The extensions, the ends of the extensions, and the contacts may be comprised of plastic(s) and/or metal(s), or any rigid material(s) and/or semi-rigid material(s), etc. and combinations thereof. However, the composition of the extensions, their shape and contact angle with the doctor blade are such that the invention, e.g., substantially reduces vibration, eliminates vibration, and/or shifts doctor blade vibration frequency during image forming.

According to an embodiment of the present invention, and referencing FIGS. 1 and 2 for discussion purposes only, at least one extension 40*a* or 40*b* may be in communication with a front surface of doctor blade 20. According to a further embodiment, both extensions 40*a* and 40*b* may be in communication with points located on either side of a center point of the doctor blade 20 front surface, e.g., they may be located at two off-centered locations.

According to another embodiment, doctor blade 20 may be aligned substantially perpendicular to the surface of developer roll 30. The angle of doctor blade 20 relative to developer roll 30 may vary. Extensions 40*a* and 40*b* may be positioned relative to doctor blade 20 to provide a force on doctor blade 20 in a direction whereby vibration and/or noise of doctor blade 20 may be substantially reduced, and/or substantially eliminated.

According to a further embodiment, extensions 40*a* and 40*b* may provide a force on doctor blade 20 in a direction away from the surface of developer roll 30 depending upon the specific doctor blade/developer roll configuration/geometry, e.g., in a direction tangent to the surface of developer roll 30. However, the force provided and direction may vary as long as doctor blade vibration and/or noise is substantially reduced and/or substantially eliminated.

As noted, according to one embodiment of the present invention, extensions 40*a* and 40*b* or an extension may extend from a biasing member holder, e.g., leaf spring holder 40 illustrated in FIGS. 1 and 2. Leaf spring holder 40, as illustrated, may be located above doctor blade 20 and holds a spring, e.g., biasing member 50, in communication with the top surface of doctor blade 20. In operation, e.g., during imagine forming, as the developer roll 30 rotates, toner from toner bin 60 may be transferred at a nip point between a lower edge/bottom surface of doctor blade 20 and developer roll 30. The pressure of doctor blade 20 against developer roll 30 may control mass flow and charge level of toner. Biasing member 50 may provide a predetermined force on doctor blade 20 that may be transferred to the nip point. Because of the possible non-uniform profile of developer roll 30, doctor blade 20 may, and often does, move in and out. Doctor blade 20, as noted previously, may be positioned at a variety of angles relative to the developer roll 30. Any vibrations of doctor blade 20 which cause undesirable noise may be substantially lessened, reduced, eliminated, or dampened by extensions 40*a* and 40*b* or an extension. Consistent positioning and consistent pressure may be necessary to provide for consistent toner transfer through the nip formed between a lower edge/bottom surface of doctor blade 20 and developer roll 30 and to possibly substantially reduce, dampen or eliminate jitter; however, vibrations, e.g., unwanted audible vibrations like noise, may occur. With the use of an extension as disclosed herein, e.g., 40*a* and 40*b*, as illustrated or a combination thereof, vibrations of doctor blade 20 may not result in unwanted/undesirable noise, e.g., a natural frequency vibration of doctor blade 20 which is substantially audible.

While illustrated herein in relation to an embodiment, extensions 40*a* and 40*b* may be located at other points along the surface, e.g., front surface of the doctor blade 20 and, e.g., may include an extension on other surfaces of doctor blade 20. Extension 40*a* and 40*b* may be located at points along a surface, e.g., a front surface, of doctor blade 20 to (1) substantially reduce or eliminate audible doctor blade vibration frequencies; (2) substantially shift the vibration frequency of the doctor blade away from its natural frequency; (3) dampen doctor blade vibration and/or noise; and/or (4) substantially disrupt the doctor blade waveform while vibrating at a natural frequency.

Figure 3:
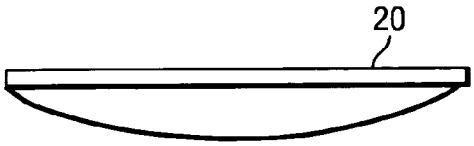
FIG. 3 (PRIOR ART)
FIG. 3 illustrates a doctor blade waveform, while vibrating at natural frequency.
Figure 4:
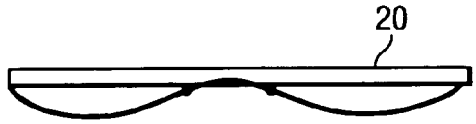
FIG. 4 illustrates a doctor blade waveform, constrained at the locations shown, according to an embodiment of the present invention.

As illustrated in an embodiment in FIGS. 1 and 2, the extension(s) may either constrain or touch or be in communication with two off-centered locations on the surface (e.g., the front surface) of doctor blade 20 during image forming. As shown in FIGS. 1 and 2 in an embodiment of the present invention, extensions 40*a* and 40*b* extend from biasing member holder 40, e.g., a leaf spring holder. As shown, the extensions 40*a* and 40*b* are located away from the center point of the doctor blade which results in the doctor blade waveform illustrated in FIG. 4. Referring to FIG. 4, doctor-blade 20 is shown constrained at two off-centered locations. As a result, during operation a doctor blade 20, a waveform results which is graphically illustrated in FIG. 4. The waveform in FIG. 4 illustrates a substantially inaudible vibration frequency thus, illustrating a substantial reduction and/or substantial elimination of unwanted and undesirable noise and/or vibrations which would be caused by an unconstrained doctor blade vibrating at a natural frequency. (See, e.g., FIG. 3).

The present invention may be carried out in specific ways other than those described herein without departing from the scope and basic characteristics of the present invention. For example, a single extension and/or contact of a sufficient width and hence, having greater surface area contact with a doctor blade than the extensions and/or contacts illustrated, could be utilized to dampen vibration and/or noise. And a combination of extensions contacting a blade at different locations may also be utilized, e.g., including a combination of front and back contacts and extensions. Consequently, the described embodiments are to be considered in all respects as illustrative and not restrictive, and all changes and modifications coming within the meaning and equivalency of the appended claims are embraced herein.

What is claimed is:

1. A toner cartridge for an image forming apparatus, said cartridge comprising:

a doctor blade having top, bottom, front and back surfaces, said doctor blade having a vibration frequency during image forming;

a housing positioned at the back surface of the doctor blade; and first and second extensions positioned in communication with two central locations on the doctor blade front surface to change the doctor blade vibration frequency during image forming, the extensions positioned on an opposite side of the doctor blade from the housing.

2. A cartridge according to claim 1, further comprising a biasing member holder to hold a biasing member in contact with the doctor blade.

3. A cartridge according to claim 2, wherein the first and second extensions extend from the biasing member holder.

4. A cartridge according to claim 3, wherein the first and second extensions are in communication with the doctor blade front surface at two off-center locations during image forming.

5. A cartridge according to claim 1, wherein the two locations on the doctor blade surface are off-center locations.

6. A cartridge according to claim 1, wherein the frequency of the doctor blade vibration is changed to a substantially inaudible frequency during image forming.

7. A cartridge according to claim 1, wherein the change in frequency of the doctor blade vibration comprises disrupting the waveform of the blade vibrating at a natural frequency.

8. A dampening system for an image forming apparatus, said system comprising:

a member that extends across and contacts a top surface of a doctor blade; and at least two dampening contacts that extend from the member for communication with a front surface of the doctor blade of the image forming apparatus to dampen noise of the blade during image forming.

9. A system according to claim 8, wherein at least one contact is adapted for positioning at a given distance away from the center of the doctor blade surface.

10. A system according to claim 8, wherein both of the contacts are adapted for positioning at a given distance on either side of the center of the doctor blade surface.

11. A system according to claim 8, wherein the contacts are adapted to touch the surface of the doctor blade disrupting a waveform of the blade vibrating at a frequency during image forming.

12. A system according to claim 11, wherein the contacts are adapted for communication with the doctor blade whereby a blade waveform is substantially shifted to an inaudible frequency during image forming.

13. A system according to claim 12, wherein one of the contacts is adapted to be an extension of a biasing member holder.

14. A system according to claim 8, wherein the contacts are adapted to be extensions of a biasing member holder of a toner cartridge.

15. A system for changing a vibration frequency of a doctor blade of an image forming apparatus, said system comprising:

at least one contact of sufficient width to communicate with a doctor blade, said contact adapted for positioning relative to a doctor blade front surface to substantially shift doctor blade vibration away from an audible frequency during image forming;

wherein the contact is adapted to extend from a leaf spring holder.

16. A system according to claim 15, further comprising a second contact adapted for communication with the doctor blade during image forming.

17. A system according to claim 16, wherein the contacts are adapted for positioning at points located off center of the doctor blade surface.

18. A system according to claim 17, wherein both contacts are adapted for positioning relative to a doctor blade front surface.

19. A system according to claim 18, wherein the contacts are adapted for positioning to substantially shift doctor blade vibration to an inaudible frequency during image forming.

20. A system according to claim 16, wherein at least one of two contacts is adapted to extend from the leaf spring holder.

21. A system according to claim 16, wherein the contacts are adapted to extend from the leaf spring holder.

22. A system according to claim 21, wherein the contacts are adapted for positioning to substantially shift doctor blade vibration to an inaudible frequency during image forming.

23. A system according to claim 21, wherein the contacts are adapted for positioning to substantially dampen noise of the doctor blade during image forming.

24. A system according to claim 15, wherein at least one contact is adapted for positioning to substantially shift doctor blade vibration to an inaudible frequency during image forming.

25. A method for substantially reducing noise created by the movement of a doctor blade of an image forming apparatus during image forming, said method comprising:

constraining a point on a surface of the doctor blade during image forming with a contact that extends from a spring holder, whereby blade vibrations are substantially shifted to an inaudible frequency; and constraining a second point on a surface of the doctor blade wherein the points are located at off center locations on a blade front surface.

* * * * *